US006774877B2

(12) United States Patent
Nishitoba et al.

(10) Patent No.: US 6,774,877 B2
(45) Date of Patent: Aug. 10, 2004

(54) CURRENT DRIVER CIRCUIT AND IMAGE DISPLAY DEVICE

(75) Inventors: Shigeo Nishitoba, Tokyo (JP); Koichi Iguchi, Tokyo (JP)

(73) Assignee: NEC Corporation, Tokyo (JP)

( * ) Notice: Subject to any disclaimer, the term of this patent is extended or adjusted under 35 U.S.C. 154(b) by 228 days.

(21) Appl. No.: 10/176,084

(22) Filed: Jun. 21, 2002

(65) Prior Publication Data

US 2002/0196212 A1 Dec. 26, 2002

(30) Foreign Application Priority Data

Jun. 25, 2001 (JP) ..... 2001-191135

(51) Int. Cl.[7] ..... G09G 3/30
(52) U.S. Cl. ..... 345/76; 315/169.3
(58) Field of Search ..... 345/76, 92, 98, 345/214, 36, 45, 204; 315/169.1, 169.3

(56) References Cited

U.S. PATENT DOCUMENTS 6,091,203 A 7/2000 Kawashima et al.
6,356,029 B1 * 3/2002 Hunter ..... 315/169.1
6,690,115 B2 * 2/2004 Kim et al. ..... 315/169.1
6,693,388 B2 * 2/2004 Oomura ..... 315/169.3
2002/0014852 A1 * 2/2002 Bae ..... 315/169.3

FOREIGN PATENT DOCUMENTS

JP 11-282419 10/1999
WO 99/65011 12/1999

* cited by examiner

*Primary Examiner*—Amare Mengistu
(74) *Attorney, Agent, or Firm*—Young & Thompson

(57) ABSTRACT

In a current driver circuit that is applicable to an organic EL (electroluminescent) image display device, the current driver circuit is provided for reducing the influence of variation between transistors that constitute a current mirror circuit while using the current mirror circuit. In the current driver circuit, a third and fourth transistor that operate in a linear region (non-saturation region) are provided between the power supply line and the sources of a first and second transistor that constitute the current mirror circuit; whereby the influence of variations between the threshold voltages of the first and second transistors can be mitigated. The gates of the third and fourth transistors are connected to the gates of the first and second transistors, respectively.

18 Claims, 21 Drawing Sheets

CURRENT DRIVER CIRCUIT AND IMAGE DISPLAY DEVICE

BACKGROUND OF THE INVENTION

1. Field of the Invention

The present invention relates to a current driver circuit for driving a current-driven element such as an organic EL (electroluminescent) element, and to an image display device that both incorporates this type of current driver circuit and uses a current-driven element as a luminous element.

2. Description of the Related Art

In recent years, devices using current-driven luminous elements such as organic EL elements have been receiving increasing attention for use as image display devices used in portable telephones or the output devices of computers. Organic EL elements are also called "organic light-emitting diodes" and have the advantage of allowing drive by direct current (dc). When organic EL elements are used in a display device, organic EL elements for each picture element (pixel) are typically arranged in matrix form on a substrate to constitute a display panel. As the construction of a display device, an active matrix arrangement is under investigation in which TFTs (thin-film transistors) are formed on this substrate and the organic EL elements of respective picture elements are driven by way of the TFTS.

Since an organic EL element is a current-driven element, however, driving an organic EL element by a TFT precludes the use of a circuit configuration that is the same as an active matrix liquid crystal display device that uses liquid crystal cells, which are voltage-driven elements. Conventionally, active matrix drive circuits have been proposed in which organic EL elements and TFTs, which are MOS (metal-oxide semiconductor) transistors, are connected in a series and inserted between a power supply line and a ground line so as to allow the application of a control voltage to the gates of the TFTS, and further, in which holding capacitors that retain this control voltage are connected to the gates of the TFTs with switching elements provided between the TFTs and signal lines for applying the control voltage to respective picture elements. In such a circuit, the control voltage is outputted in a time-division manner to each picture element on the signal lines, and each switching element is controlled to enter a conductive state (ON state) only at the timings at which the control voltage is outputted to the corresponding picture elements. Thus, when a switching element enters the conductive state, the control voltage at that time is applied to the gates of the TFTS, whereby a current that accords with the control voltage flows through the organic EL element and the holding capacitor is charged by this control voltage. If the switching element transits to the cut-off state (OFF state) in this state, the already applied control voltage continues to be applied to the gates of the TFTs under the effect of the holding capacitor, and a current that accords with this control voltage therefore continues to flow to the organic EL element. This type of the circuit is disclosed in, for example, W099/65011.

In this circuit of the prior art, however, the occurrence of variations in the characteristics of the TFT brings about variations in the current that flows to the organic EL element of each picture element despite the application of the same control voltage, and these variations therefore prevent the realization of a suitable display, particularly when performing a gray-scale display. In addition, the occurrence of voltage drops on the fine signal lines also results in variations in the current that flows to organic EL elements.

In the interest of solving the above-described problems when constituting an active matrix display device, the assignee of this invention has previously proposed in Japanese Patent Laid-open Application No. 11-282419 (JP, 11282419, A), which corresponds to U.S. Pat. No. 6,091,203 of Kawashima et al., a current driver circuit that is directed toward driving current-driven active elements such as the organic EL elements that constitute the picture elements of this type of display device. FIG. 1 is a circuit diagram showing the basic circuit configuration of the current driver circuit proposed in JP, 11282419, A. This figure shows the circuit of one picture element.

The circuit shown in FIG. 1 is arranged such that signal current on signal line 53 is converted, by means of a current mirror circuit composed of n-channel transistors 56 and 58, to a driving current that flows to organic EL element 61, and such that organic EL element 61 is driven at a constant current by the driving current that accords with the signal current. Power-supply line 51 and ground line 52 are provided, the power supply voltage being positive, the anode of organic EL element 61, which is provided as the load of transistor 58, is connected to power-supply line 51, and the cathode of organic EL element 61 is connected to the drain of transistor 58. The sources of transistors 56 and 58 are each connected to ground line 52. The gate and drain of transistor 56 are connected to each other and further connected to the gate of transistor 58 by way of switch element 62. Holding capacitance 60 is provided between the gate of transistor 58 and ground line 52. The drain of transistor 56 is connected to signal line 53 by way of switch element 63. Switch elements 62 and 63 are constituted by, for example, MOS switches, and the control terminals of each are connected to selection line 54. If MOS transistors are used for switch elements 62 and 63, the control terminals are the gate terminals the MOS transistors.

When selection line 54 become active and switch elements 62 and 63 become conductive, the signal current supplied from signal line 53 flows to transistor 56 that is diode-connected by way of switch element 63, and holding capacitor 60 is charged until the voltage across both ends of holding capacitor 60 reaches the gate-to-source voltage of transistor 56. Since transistors 56 and 58 constitute a current mirror circuit, a current that has the same magnitude as the signal current from signal line 53 flows to transistor 58 if the channel length and channel width of transistors 56 and 58 are the same, and this current flows to organic EL element 61, which is the load of transistor 58.

When selection line 54 becomes inactive and switch elements 62 and 63 enter the cutoff state, the signal current is not supplied from signal line 53 because switch element 63 is in the cutoff state, but the voltage level in holding capacitor 60 that is connected to the gate of transistor 58 remains at the same value as when switch elements 62 and 63 were in the conductive state because switch element 62 is in the cutoff state, and transistor 58 therefore continues to direct to organic EL element 61 a current of the same value as when switch elements 62 and 63 were conductive.

In this circuit, causing a signal current to flow instead of applying a control voltage to the signal line can curtail the effect of voltage drops in the signal line, and using a current mirror circuit allows a driving current to be obtained that accords with the signal current and that is unaffected by differences in transistor characteristics between the picture elements.

Nevertheless, in contrast with transistors formed on a single-crystal silicon semiconductor substrate, when the transistors that make up the above-described current driver circuit are constituted by amorphous silicon TFTS (thin-film transistors) or polycrystalline silicon TFTS, variations in threshold voltage $V_{th}$ on the order of several tens of millivolts may occur even when these TFTS are arranged contiguous to each other. Thus, despite the contiguous arrangement of transistors 56 and 58 that make up the current mirror circuit in the circuit shown in FIG. 1, variations in threshold are difficult to suppress and matching of the two transistors 56 and 58 is therefore difficult to achieve. In addition to variations in threshold value, variations in the carrier mobility or gate oxide film thickness of the transistor may also prevent matching of the transistors that make up a current mirror circuit. Variations in the threshold value, carrier mobility, and gate oxide film thickness prevent matching between transistors and result in large variations in the input/output characteristic of the current mirror circuit.

The circuit shown in FIG. 1 is of a configuration for transferring the signal current that is supplied from signal line 53 to organic EL element 61, which is the load, by way of a current mirror circuit made up by transistors 56 and 58, but failure to achieve matching of the gate-to source voltages of transistors 56 and 58 as described in the foregoing explanation prevents accurate transfer of the signal current from signal line 53 to organic EL element 61. FIG. 2 shows the input/output transfer characteristic of the current mirror circuit when the threshold values $V_{th}$ of the two transistors 56 and 58 that constitute the current mirror circuit each vary by 50 mV. The channel length and channel width of each of transistors 56 and 58 is 4 $\mu$m. The inclined line shown in the center of the graph represents the transfer characteristic when no variation occurs in the threshold value, and the lines on either side of this line represent the transfer characteristics when variations occur in the threshold value. As shown in FIG. 2, when threshold value $V_{th}$ varies by approximately ±50 mV, the output current, i.e., the current that flows to the organic EL element, varies by approximately ±13%.

Thus, in the current driver circuit shown in FIG. 1 as well, when TFTs are used to constitute a circuit that is applied in an organic EL picture display device, there remain various problems to be solved, such as the occurrence of gray-scale error between picture elements which results in a decrease in picture quality in the display panel, and further, a drop in production yield and the consequent increase in cost.

SUMMARY OF THE INVENTION

It is an object of the present invention to provide a current driver circuit that is suitable for, for example, an organic EL image display device and that mitigates the influence of variations between the transistors that make up a current mirror circuit while using the current mirror circuit.

It is another object of the present invention to provide an image display device having this type of current driver circuit.

The present invention relates to a current driver circuit that uses a current mirror circuit as described in the foregoing explanation. Although current mirror circuits exist in various forms, a basic configuration is provided with: a first transistor for generating a gate potential that accords with the drain current and a second transistor having its drain connected to a current-driven element and that is configured such that a potential that accords with the gate potential of the first transistor is applied to the gate of the second transistor. By means of this basic configuration, when a signal current is caused to flow to the first transistor, the second transistor drives the current-driven element by means of a drain current that accords with the signal current. In the present invention, such a current mirror circuit is provided with: a third transistor that has its gate connected to the gate of the first transistor, that is connected in a series to the source of the first transistor, and that operates in a non-saturation region (linear region); and a fourth transistor that has its gate connected to the gate of the second transistor, that is connected in a series to the source of the second transistor, and that operates in a non-saturation region. The provision of this third and fourth transistor mitigates the influence of variations between the transistors that make up the current mirror circuit. In this case, the third and fourth transistors essentially function as resistance.

The method of arranging the third and fourth transistors in the present invention is open to various modifications according to differences in the form and configuration of the current mirror circuit, and actual examples of these arrangements will be clarified by embodiments of the present invention that are described hereinbelow.

Essentially, the object of the present invention is realized by a current driver circuit that includes: a current mirror circuit that includes at least a first transistor and a second transistor, the first transistor generating a gate potential that accords with the drain current, and a second transistor having its drain connected to a current-driven element wherein the application of a potential that accords with the gate potential of the first transistor to the gate of the second transistor causes the second transistor to drive the element at a current that corresponds to the drain current of the first transistor; a holding capacitor for holding the gate potential of the second transistor; a first switch element for connecting the drain of the first transistor to a signal line that provides a signal current in accordance with a received control signal; a second switch element that enters either a conductive or cutoff state in accordance with a received control signal and that causes the current mirror circuit to operate when in the conductive state and both prevents operation of the current mirror circuit and cuts off the charge/discharge path from the holding capacitor when in the cutoff state; a third transistor that is inserted between the source of the first transistor and a line that supplies the source currents of the first and second transistors, and that operates within a non-saturation region; a fourth transistor that is inserted between the source of the second transistor and the line that supplies the source currents of the first and second transistors, and that operates in a non-saturation region.

In the present invention, connecting transistors, which operate in a non-saturation region (linear region) and that essentially function as resistance, to the transistors that constitute the current mirror circuit enables suppression of variations between the input and output currents of the current mirror circuit and allows a current driver circuit to be obtained that can drive an element accurately based on a signal current. Application of the present invention therefore allows an improvement in the picture quality of a display image in, for example, an organic EL display device.

The above and other objects, features, and advantages of the present invention will become apparent from the following description with reference to the accompanying drawings, which illustrate examples of the present invention.

DETAILED DESCRIPTION OF THE PREFERRED EMBODIMENTS

Figure 1:
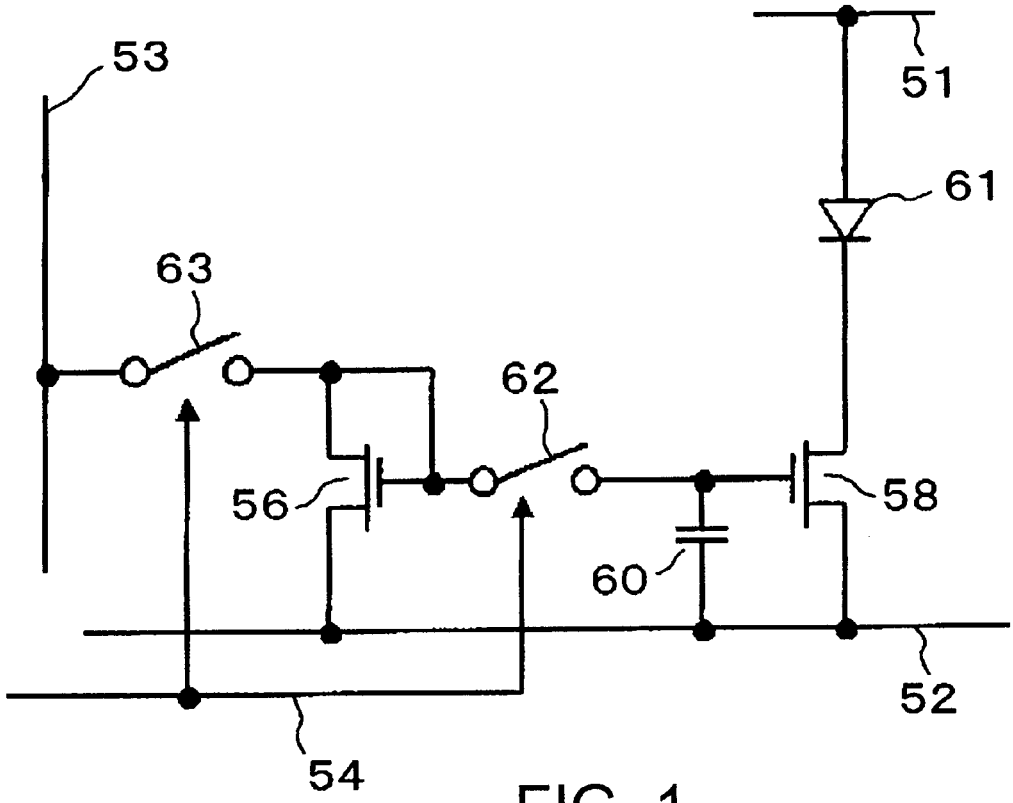
FIG. 1 (BACKGROUND ART)
FIG. 1 is a circuit diagram showing the configuration of a current driver circuit of the prior art.
Figure 3:
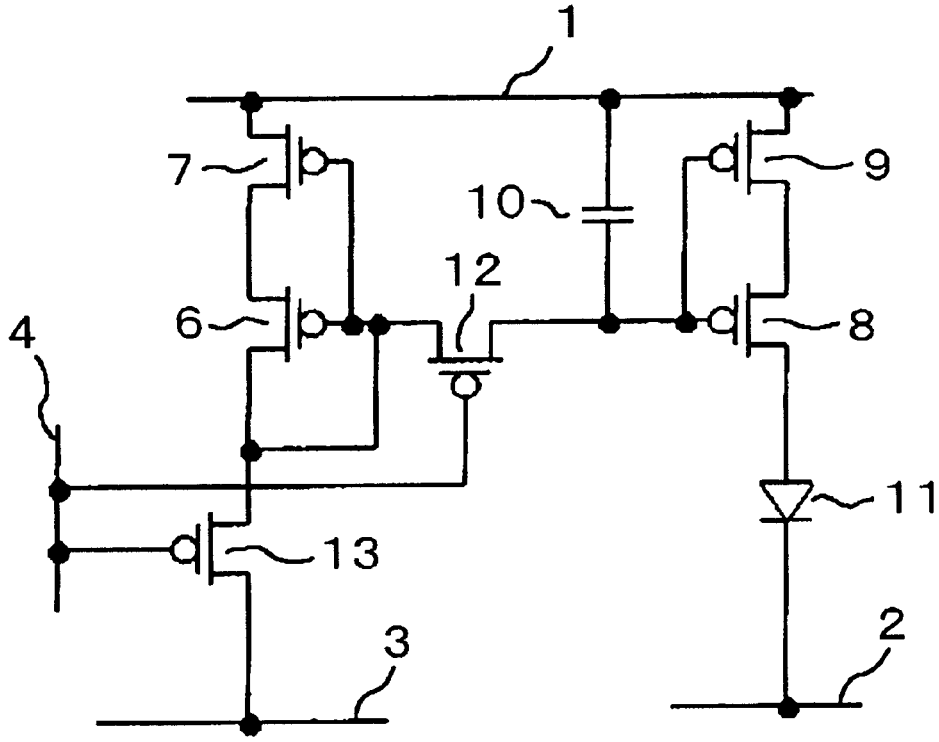
FIG. 3 is a circuit diagram showing the current driver circuit according to a first embodiment of the present invention.

As with the current driver circuit of the prior art that is shown in FIG. 1, the current driver circuit according to a first embodiment of the present invention shown in FIG. 3 is provided with a current mirror circuit and drives organic EL (electroluminescent) element 11 at a constant current by means of a driving current that accords with a signal current supplied from signal line 3. In the circuit shown in FIG. 3, however, the MOS transistors that constitute the current mirror circuit are p-channel MOS transistors, and the arrangement relation between the organic EL element and the current mirror circuit that is arranged between the power supply line and ground line is therefore the reverse of the circuit that is shown in FIG. 1, which uses n-channel MOS transistors. The point of greatest difference between the circuit shown in FIG. 3 and the circuit shown in FIG. 1 is the additional insertion of transistors 7 and 9 on the side of the sources of each of transistors 6 and 8 that make up the current mirror circuit, i.e., the adoption of a double-gate structure. The current driver circuit shown in FIG. 3 is explained below in greater detail. In this example, the power supply voltage is positive with respect to the ground potential.

Power supply line 1 to which the power supply voltage is applied and ground line 2 in which the ground potential is held are provided, the cathode of organic EL element 11 being connected to ground line 2 and the anode of element 11 being connected to the drain of transistor 8. The source of transistor 8 is connected to the drain of transistor 9; and the source of transistor 9 is connected to power supply line 1. The gates of transistors 8 and 9 are connected to each other. Holding capacitor 10 is provided between power supply line 1 and the commonly connected gates of transistors 8 and 9.

The drain and gate of transistor 6 are connected together, and further, to the gate of transistor 7. The source of transistor 6 is connected to the drain of transistor 7, and the source of transistor 7 is connected to power supply line 1. The gate of transistor 6 is connected to the gate of transistor 8 by way of switch transistor 12. The drain of transistor 6 is connected to signal line 3 by way of switch transistor 13. The gates of switch transistors 12 and 13 are connected to selection line 4.

In this circuit, transistors 6 to 9 and switch transistors 12 and 13 are all p-channel MOS transistors and are typically formed as TFT (thin-film transistor). A current mirror circuit of double-gate structure is constituted by transistors 6 to 9, but of these transistors, transistors 6 and 8 function as the original current mirror circuit and operate in the saturation region of the MOS transistors. In contrast, transistors 7 and 9 are provided for compensating variations in the threshold value $V_{th}$ of transistors 6 and 8 and operate in a non-saturation region (linear region), and essentially function as resistors having resistance in accordance with the voltage across the gates and sources. Considering the ease of arranging TFTs that are used for providing a current driver circuit for each picture element on the image display panel, the channel width of transistors 6 and 7 are preferably equal to each other, and the channel width of transistors 8 and 9 are preferably made equal to each other. In addition, considering that transistors 7 and 9 operate in the non-saturation region in contrast with transistors 6 and 8, which operate in the saturation region as the current mirror circuit, the channel length of transistors 7 and 9 must be sufficient to operate in the non-saturation region.

Figure 4:
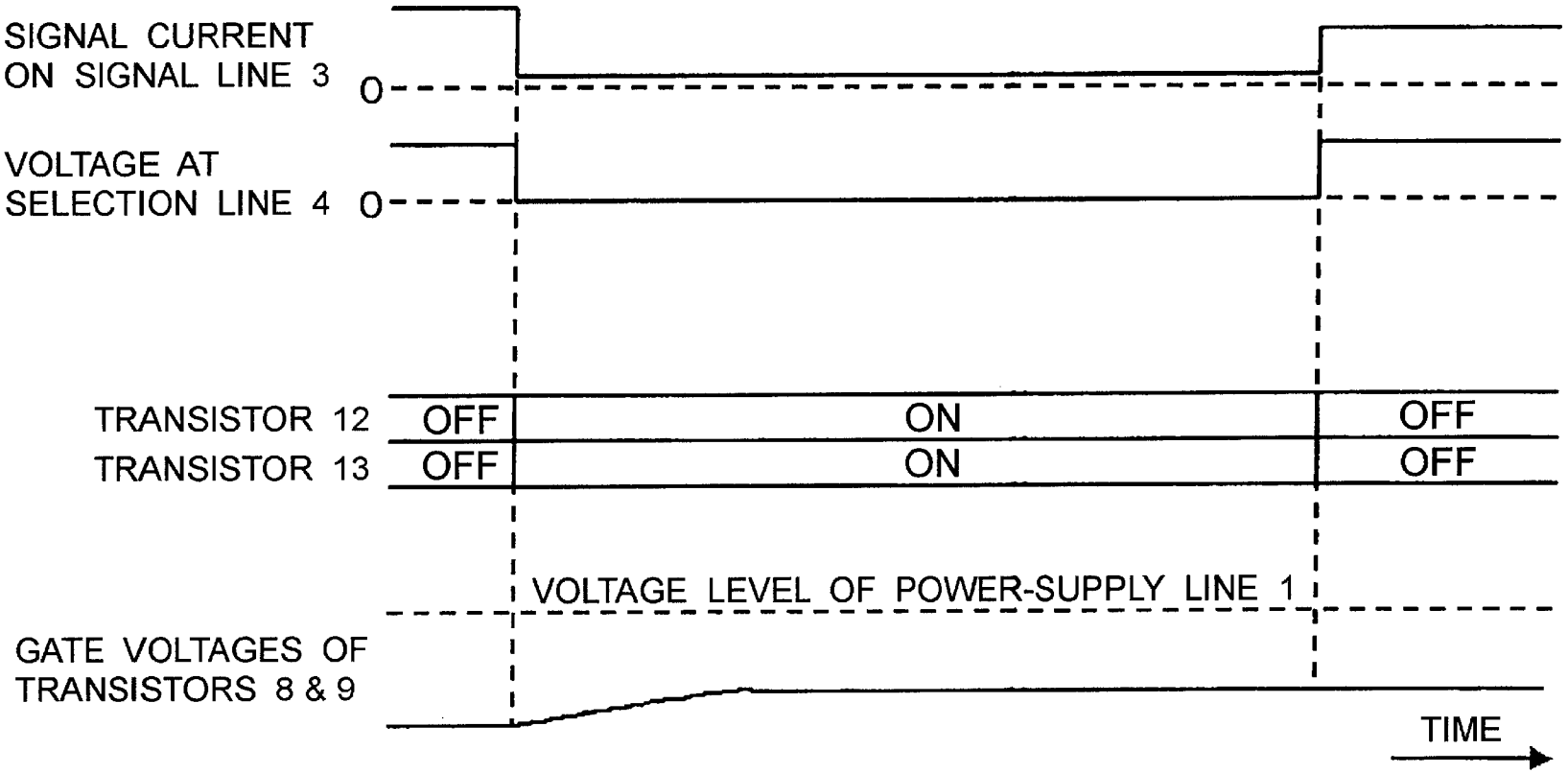
FIG. 4 is a timing chart showing the operation of the circuit shown in FIG. 3.

Referring now to the timing chart of FIG. 4, the operation of this current driver circuit is next described. In contrast with the circuit shown in FIG. 1, p-channel transistors are used and selection line 4 is therefore in an active state at low level and in an inactive state at high level.

When selection line 4 becomes low level and enters the active state, switch transistor 13 becomes conductive (ON state), and the signal current is therefore supplied from signal line 3 and flows through transistors 6 and 7. Switch transistor 12 also becomes conductive at this time, and the current mirror circuit of double-gate structure that is constituted by transistors 6 to 9 therefore operates and current is supplied from the drain of transistor 8 to organic EL element 11, which is the load. The signal current that is supplied from signal line 3 is converted to the voltage across the gate and source of transistor 9, and holding capacitor 10 is charged up to this converted gate-to-source voltage. Holding capacitor 10 holds the voltage across the gate and source of transistor 9 that has been converted by the signal current that is supplied from signal line 3.

When selection line 4 becomes high level and transits to the inactive state, switch transistors 12 and 13 enter the cutoff state (OFF state) and transistors 6 and 7 enter the cutoff state. Since switch transistor 12 is in the cutoff state, the previously converted gate-to-source voltage is retained without change in holding capacitor 10, and the gates of transistors 8 and 9 are driven by the voltage that is retained in holding capacitor 10. As a result, transistors 8 and 9 continue to supply current to organic EL element 11 that is equal to the current when selection line 4 was in the active state.

Figure 2:
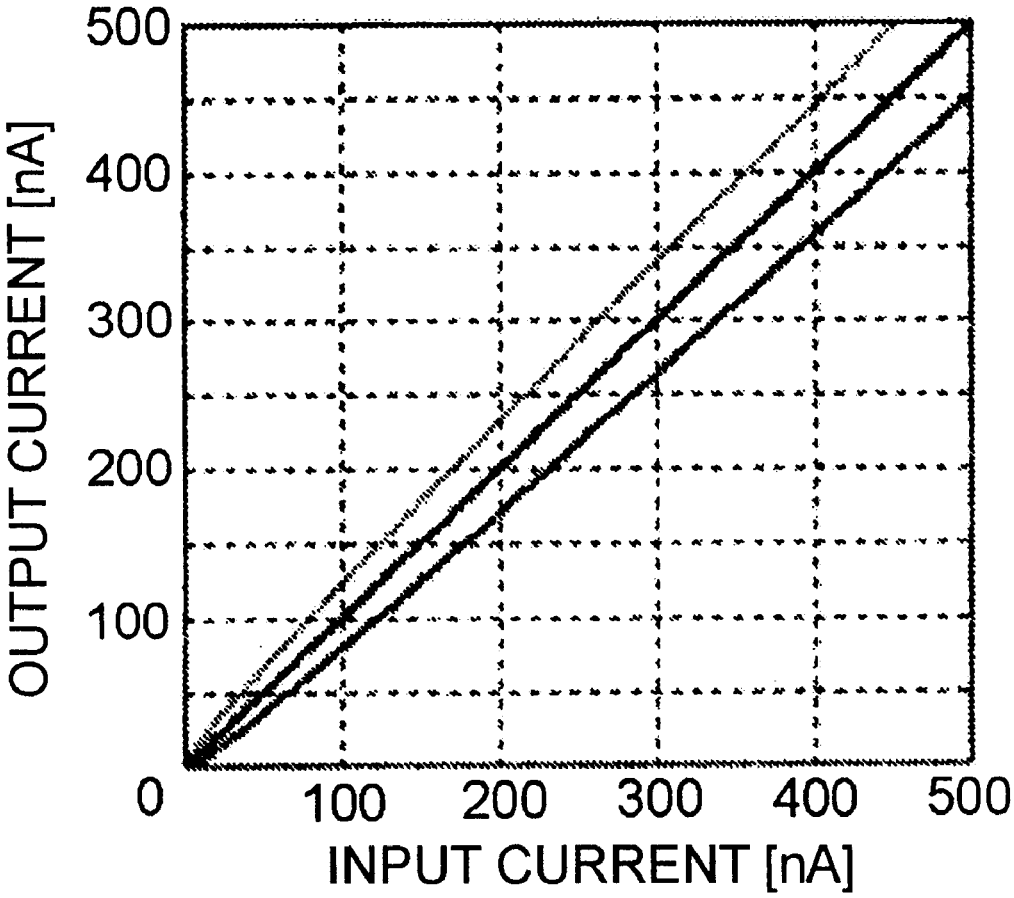
FIG. 2 (BACKGROUND ART)
FIG. 2 is a graph showing the input/output transfer characteristics of a current mirror circuit when variations in characteristics occur between the transistors that make up the current mirror circuit.
Figure 5:
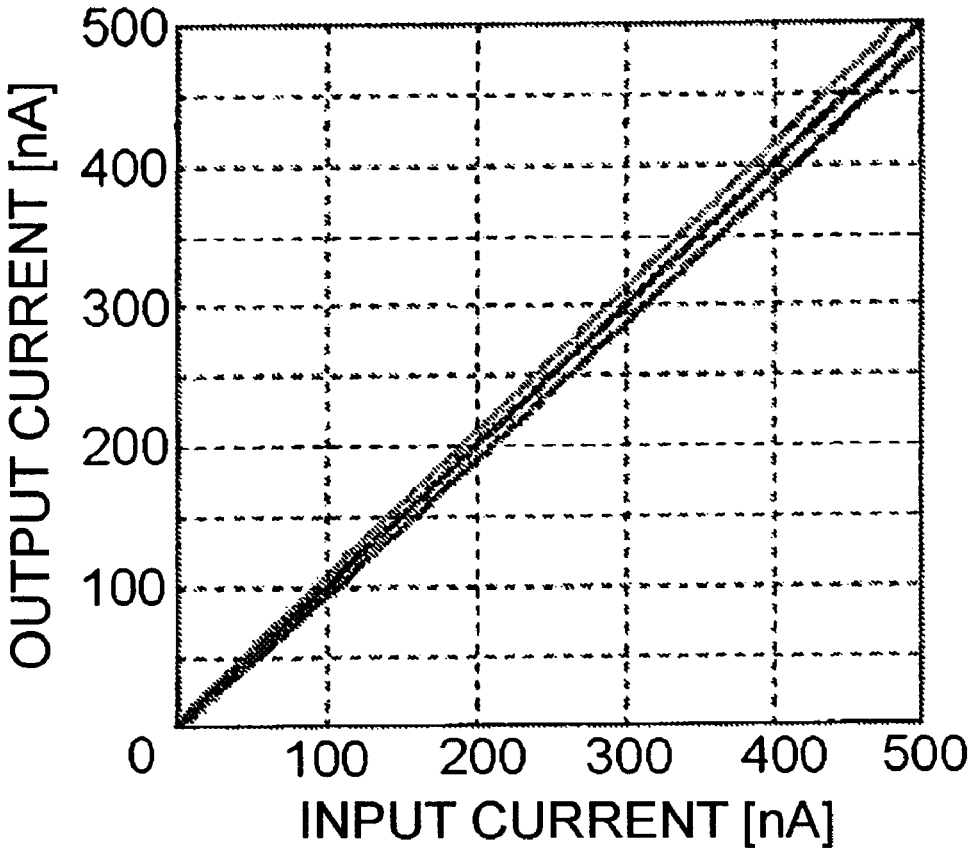
FIG. 5 is a graph showing the input/output transfer characteristics of a current mirror circuit when variations in characteristics occur between the transistors that make up the current mirror circuit in the current driver circuit shown in FIG. 3.

FIG. 5 is a graph showing the degree of variation in input/output characteristic of the above-described current mirror circuit of double-gate structure in the circuit shown in FIG. 3 when the threshold value $V_{th}$ of the transistors that make up this current mirror circuit vary by ±50 mV. In this case, transistors 6 to 9 all have a channel length of 4 $\mu$m and a channel width of 4 $\mu$m. As can be understood from FIG. 5, adoption of the double-gate structure reduces variations in output current to ±3%. As shown in FIG. 2, when the current mirror circuit is not of double-gate structure, output current under the same conditions varies by ±13%. In addition, the adoption of the double-gate structure similarly reduces variation in the output current of the current mirror circuit despite variations not only in the threshold value, but also in gate oxide film thickness and carrier mobility of the thin-film transistors.

Figure 6:
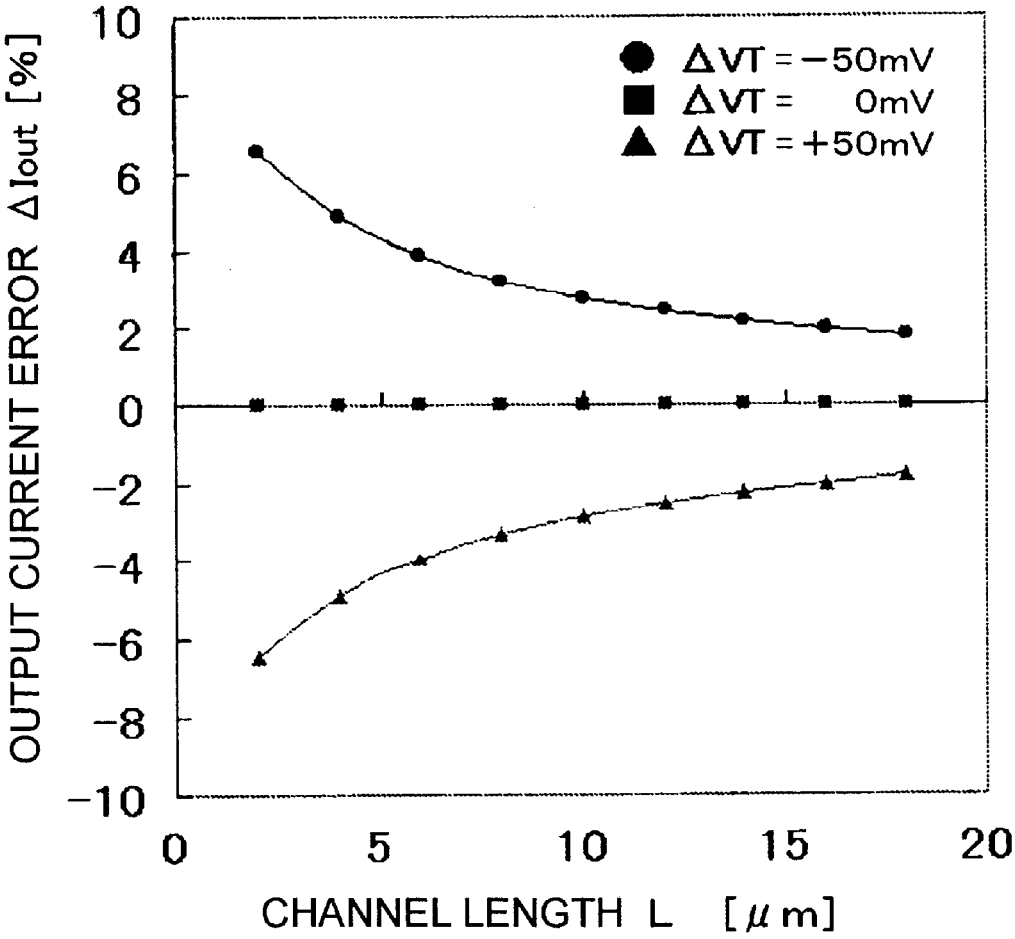
FIG. 6 is a graph showing the relation between the output current error of a current mirror circuit and the channel length of a transistor when variations occur in the threshold values of transistors.

FIG. 6 shows the relation between the channel length of transistors 7 and 9 and variations in output current in the current mirror circuit shown in FIG. 3 with variations in the transistor threshold value of ±50 mV. The channel length of transistors 6 and 8 is 4 $\mu$m, and the channel width of transistors 6 to 9 is 4 $\mu$m. As can be seen from FIG. 6, variation decreases as the channel length of transistors 7 and 9 increases. Thus, when applying the current driver circuit of this embodiment to an image display device, the desired characteristics can be obtained by selecting the channel length of transistors 7 and 9 according to the picture quality that is demanded of the image display device. Making the channel length of transistors 7 and 9 too long, however, results in excessive voltage drop in these transistors 7 and 9, and is undesirable from the aspects of power consumption and power supply voltage. The channel length of transistors 7 and 9 is preferably set to at least 0.5 times the channel length of transistors 6 and 8, and more preferably to at least one time but not greater than four times the channel length of transistors 6 and 8.

Thus, in the present embodiment, transistors 6 and 7 and transistors 8 and 9 that constitute the current mirror circuit are all configured for realizing the double-gate structure, transistors 7 and 9 being used in the linear region essentially as resistance, and as a result, a current mirror circuit can be realized in which the voltage that occurs in transistors 7 and 9 is dominant, variations in the gate-to-source voltage of transistors 6 and 8 are reduced, and variations between the input and output currents are decreased.

Figure 7:
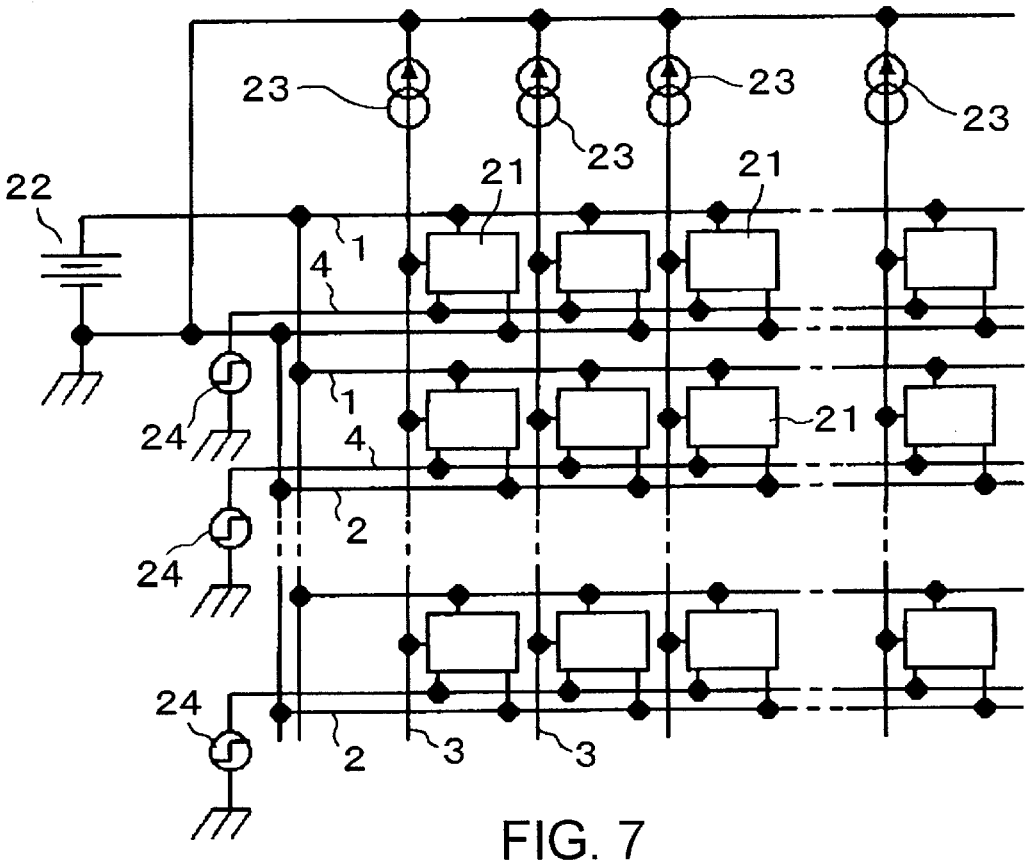
FIG. 7 is a circuit diagram showing an image display device that uses the current driver circuit shown in FIG. 3.

FIG. 7 shows an image display device that is realized by arranging current driver circuits shown in FIG. 3 in matrix form. In FIG. 7, the current driver circuits shown in FIG. 3 are arranged as picture elements (pixels) 21 in m rows and n columns. Picture elements 21 that belong to the same row share the same power supply line 1 and ground line 2, power supply lines 1 of each row being collectively connected to one end of dc power supply 22, and ground lines 2 of each row being collectively connected to the other terminal of power supply 22. Picture elements 21 belonging to the same row also share selection line 4, and signal drivers 24 that generate control signals are connected to each of the total of m selection lines 4. Picture elements 21 belonging to the same column share a signal line 3, and current drivers 23 that generate the signal current are connected to each of the total of n signal lines 3. This display device is further provided with a control circuit not shown in the figure, and this control circuit controls the current values that are outputted by each current driver 23 as well as the timing of the generation of control signals in each signal driver 24.

The m signal drivers 24 output control signals in order, whereby control signals are outputted in order to selection lines 4 from the first row to the $M^{th}$ row. On The n current drivers 23 output signal currents in parallel to picture elements 21 belonging to the row that is selected by selection lines 4. As a result, a signal current from a current driver 23 is supplied to the current driver circuits that constitute each picture element 21 of a selected row, whereby organic EL elements 11 emit light corresponding to the signal current. In addition, as described in the forgoing explanation, if a row that has been selected by selection line 4 becomes the non-selected state, the same current as when selected continues to flow to organic EL element 11 in each picture element 21 of that row.

Although p-channel transistors are used as switch transistors 12 and 13 in the current driver circuit shown in FIG. 3, n-channel transistors may also be used. In such a case, switch transistors 12 and 13 become conductive and the current mirror circuit of double-gate structure that is constituted by transistors 6 to 9 operates when selection line 4 is high level. On the other hand, switch transistors 12 and 13 enter the cutoff state when selection line 4 is low level.

Figure 8:
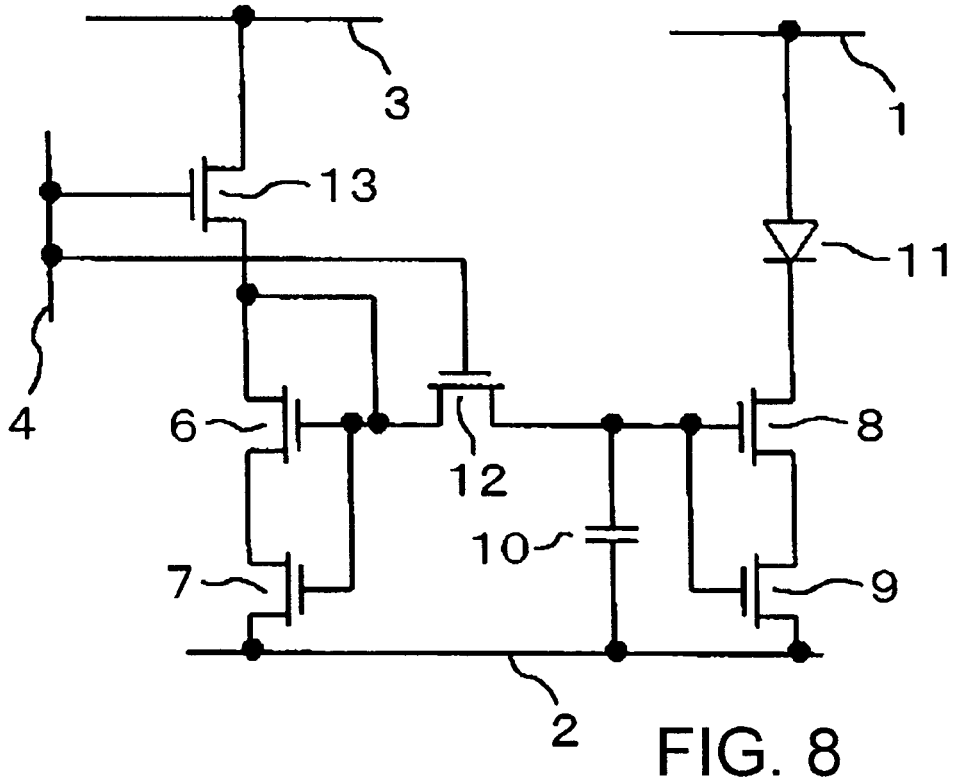
FIG. 8 is a circuit diagram showing another example of the current driver circuit of the first embodiment.

Further, the transistors that constitute the switch transistors and the current mirror circuit of double-gate structure may all be constituted by n-channel transistors. The circuit configuration in such a case is shown in FIG. 8. Reversing the conductivity of the transistors results in a configuration in which organic EL element 11 is connected to power supply line 1, which is a positive power supply, and the current mirror circuit is provided on the ground line 2 side. In such a circuit, the current mirror circuit operates when selection line 4 is high level.

Figure 9:
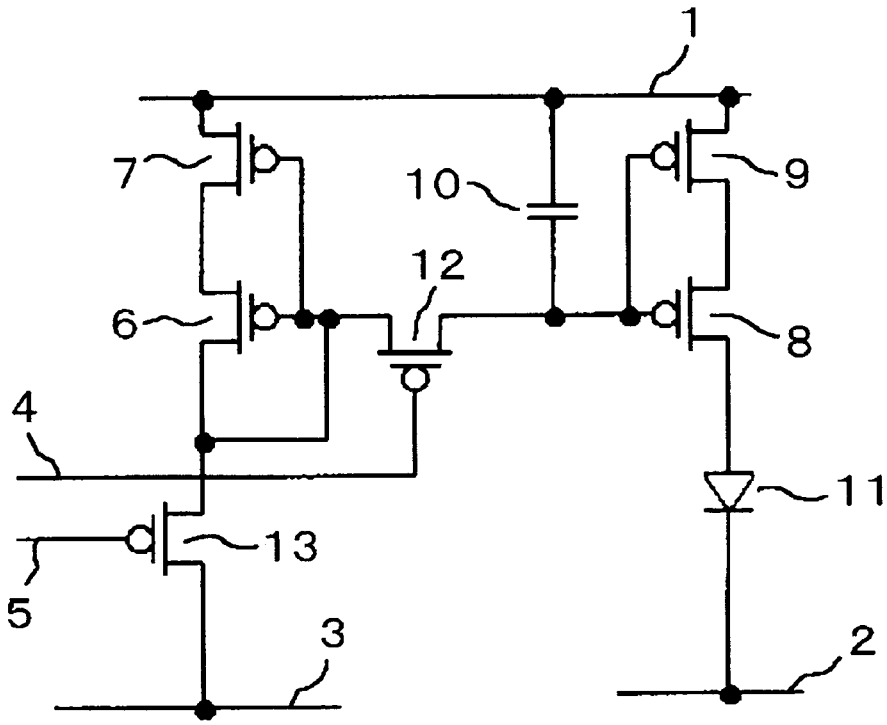
FIG. 9 is a circuit diagram showing the current driver circuit according to a second embodiment of the present invention.
Figure 10:
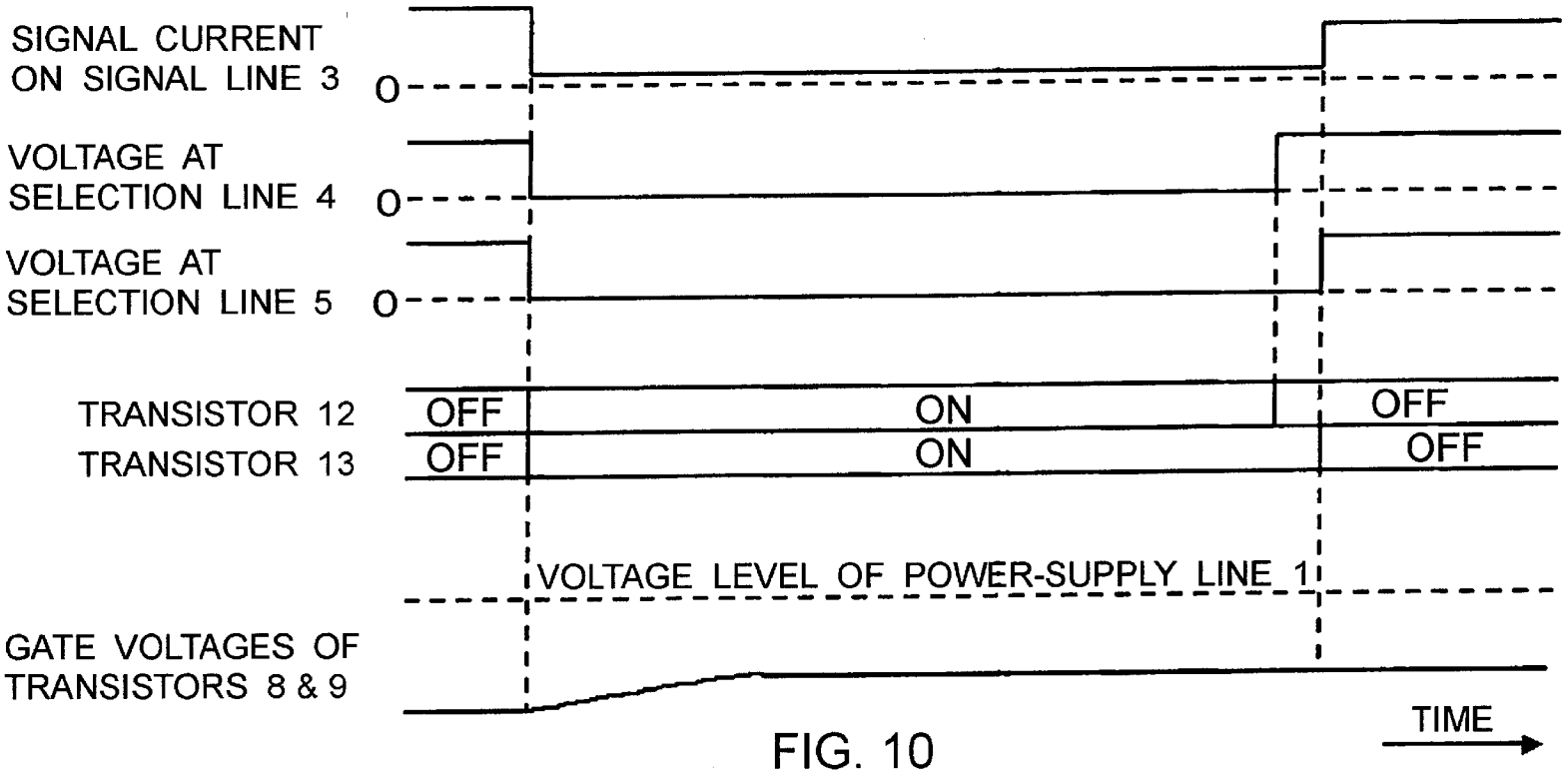
FIG. 10 is a timing chart showing the operation of the circuit shown in FIG. 9.

Referring now to FIGS. 9 and 10, the current driver circuit according to a second embodiment of the present invention is next described.

Although selection line 4 was connected in common to the gates of switch transistors 12 and 13 in the circuit shown in FIG. 3, in the current driver circuit of the second embodiment shown in FIG. 9, the selection line is split with selection line 4 being connected to the gate of switch transistor 12 and selection line 5 being connected to the gate of switch transistor 13. In this circuit of the second embodiment, selection lines 4 and 5 become low level (active state) and the signal current from signal line 3 is converted to voltage, following which, as shown in the timing chart of FIG. 10, selection line 4 is first set to high level and switch transistor 12 placed in the cutoff state, and selection line 5 is then set to high level and switch transistor 13 placed in the cutoff state so that the converted voltage can be accurately retained in holding capacitance 10.

Although p-channel transistors were used for switch transistors 12 and 13 in the circuit shown in FIG. 9, n-channel transistors may also be used, as in the first embodiment. N-channel transistors may also be used as transistors 6 to 9.

Figure 11:
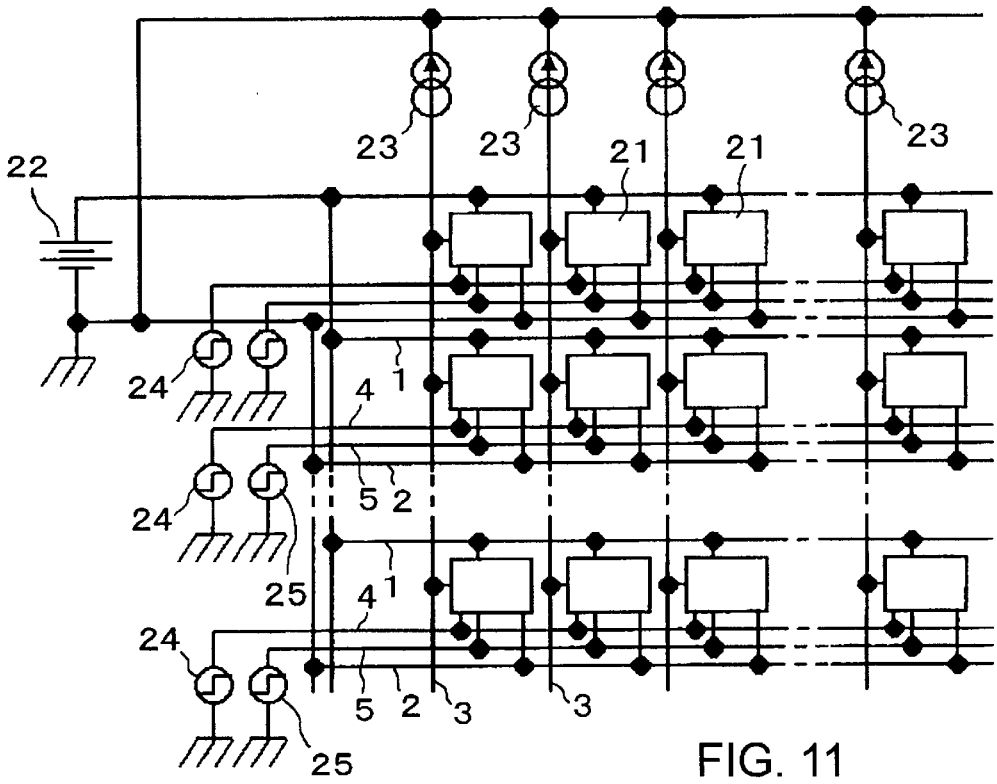
FIG. 11 is a circuit diagram showing an image display device that uses the current driver circuit shown in FIG. 9.

FIG. 11 shows the configuration of an image display device that uses the current driver circuit shown in FIG. 9. Picture elements 21 that belong to the same row share selection line 4, and further, share selection line 5. The point of difference between this image display device and the image display device of the first embodiment shown in FIG. 7 is the separate provision of signal drivers 24 that drive selection lines 4 and signal drivers 25 that drive selection lines 5 to allow the use of the current driver circuit shown in FIG. 9 as picture element 21. This image display device is further provided with a control circuit that is not shown in the figure, and this control circuit controls the current value that is outputted by each current driver 23 as well as the timing of generation of control signals by each of signal drivers 24 and 25.

Figure 12:
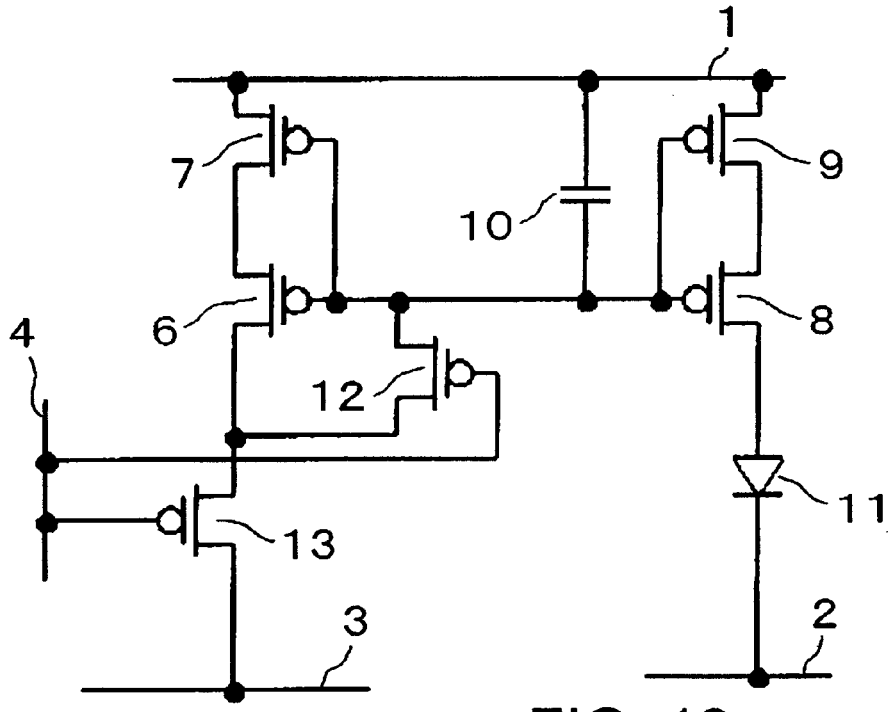
FIG. 12 is a circuit diagram showing the current driver circuit according to a third embodiment of the present invention.

The current driver circuit according to a third embodiment of the present invention is next explained using FIG. 12. In the circuit shown in FIG. 3, switch transistor 12 was provided between the gate of transistor 6 and the gate of transistor 8 for both halting operation of the current mirror circuit when not selected and for preventing the escape of the charge that has accumulated in holding capacitor 10. However, the position of switch transistor 12 is not limited to this form. The circuit shown in FIG. 12 is a configuration in which switch transistor 12 in the circuit shown in FIG. 3 is inserted between the gate and drain of transistor 6, and the gate of transistor 6 and the gate of transistor 8 are directly connected.

In the circuit shown in FIG. 12, operation when selection line 4 is low level, i.e., when in the active state, is the same as the circuit shown in FIG. 3 because switch transistors 12 and 13 are in the conductive state. When selection line 4 transits to high level, i.e., when changed to the inactive state, the drain and gate of transistor 6 are isolated and transistors 6 and 8 no longer function as a current mirror circuit. In addition, switch transistor 12 enters the cutoff state, whereby the outflow/inflow paths of the charge that is held in holding capacitor 10 are stopped and holding capacitor 10 maintains without change the voltage that was held when selected. As a result, the same current as when selected continues to flow to organic EL element 11. Using this current driver circuit shown in FIG. 12 enables an image display device to be constituted that is similar to the image display device shown in FIG. 7.

Figure 13:
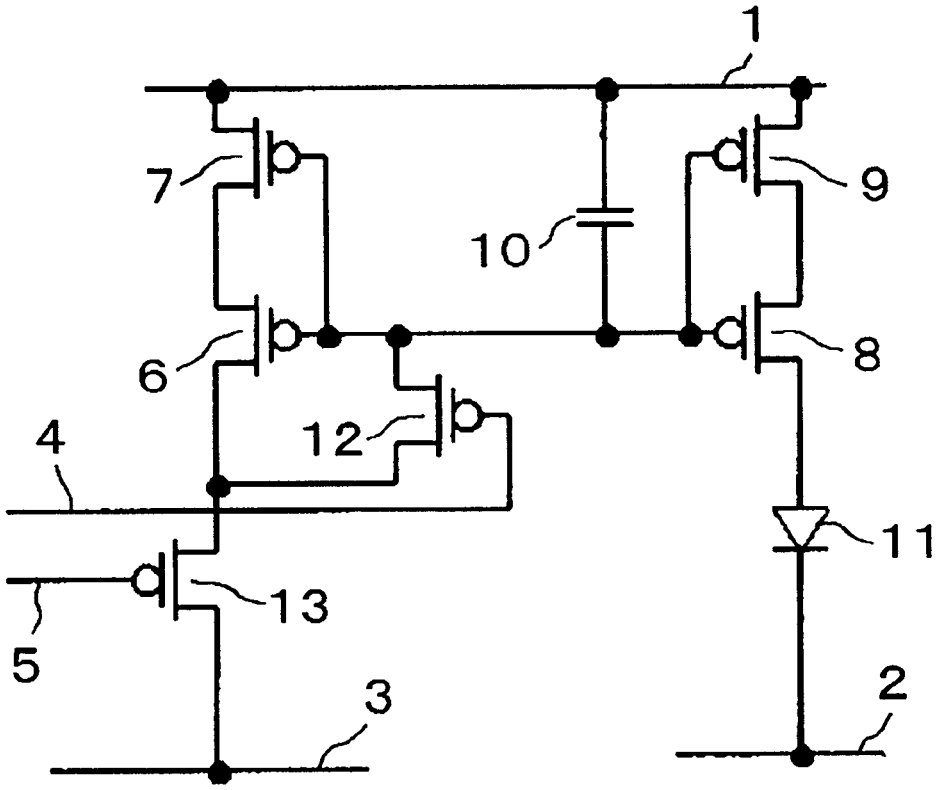
FIG. 13 is a circuit diagram showing another example of the current driver circuit of the third embodiment.

FIG. 13 shows another example of a current driver circuit according to the third embodiment. The circuit shown in FIG. 13 is similar to the circuit shown in FIG. 12, but the selection lines are separated as in the circuit of the second embodiment (see FIG. 9), selection line 4 being connected to the gate of switch transistor 12 and selection line 5 being connected to the gate of switch transistor 13. In this circuit, after selection lines 4 and 5 become low level, i.e., enter the active state, and the signal current from signal line 3 is converted to voltage, selection line 4 is first set to high level and switch transistor 12 placed in the cutoff state following which selection line 5 is set to high level and switch transistor 13 is placed in the cutoff state so that this voltage is accurately held in holding capacitor 10. Using the current driver circuit shown in FIG. 13 enables an image display device to be constituted that is similar to the image display device shown in FIG. 11.

Figure 14:
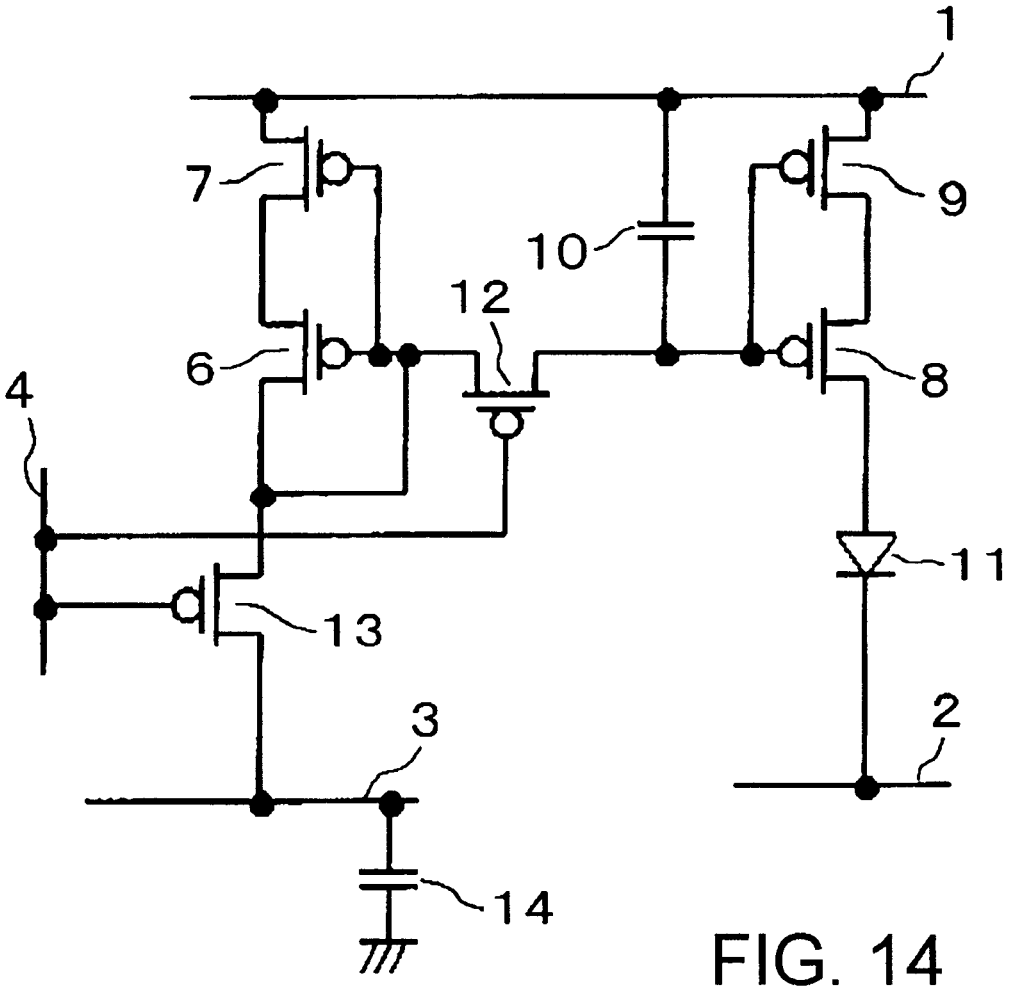
FIG. 14 is a circuit diagram showing the current driver circuit according to a fourth embodiment of the present invention.

The current driver circuit according to a fourth embodiment of the present invention that is shown in FIG. 14 is a circuit in which parasitic capacitance 14 of signal line 3 is clearly added to the circuit shown in FIG. 3. In each embodiment of the current driver circuit, transistors 6 to 9 and switch transistors 12 and 13 are normally formed by TFTs each having an insulated-gate structure, and the wiring layer in a TFT structure is normally formed from aluminum (Al) wiring or tungsten silicide (WSi) wiring. Parasitic capacitance 14 occurs due to crossings of portions of the wiring. When the signal current is sufficiently large, the existence of some parasitic capacitance presents no problem because only a slight amount of time is required to charge the parasitic capacitance. When this current driver circuit is applied to an organic EL active matrix display device, however, the signal current is at an extremely low level, for example, on the order of microamperes. The danger therefore exists that the signal current that is supplied from signal line 3 will be used to charge parasitic capacitance 14 and the voltage at both ends of holding capacitor 10 during the time that selection line 4 is low level will not reach the originally predetermined voltage. The originally predetermined voltage is a voltage that corresponds to the current that current driver 23 (see FIG. 7) outputs to signal line 3. If the voltage across two ends of holding capacitor 10 during a period in which selection line 4 is low level do not attains the originally predetermined voltage, the current that flows through organic EL element 11 will not attain the current that has been outputted from current driver 23 to signal line 3, and this will result in deterioration of display picture quality on an organic EL active matrix display device.

If the channel widths (i.e., gate widths) of transistors 6 and 7 are each set to N times the channel widths of transistors 8 and 9 (where N>1) and the current value that is to flow to organic EL element 11 is not changed, the signal current that is supplied from signal line 3 will be N times the signal current in the circuit that is shown in FIG. 3. Thus, even though parasitic capacitance may exist in signal line 3, the time interval for charging this parasitic capacitance will be reduced. In addition, the charging of holding capacitor 10 will obviously occur at N times the current and the charging time will therefore be shortened. The value of N may be selected by taking into consideration such factors as the value of parasitic capacitance 14 that is added to signal line 3, the value of holding capacitor 10, and the length of the interval that selection line 4 is low level.

Figure 15:
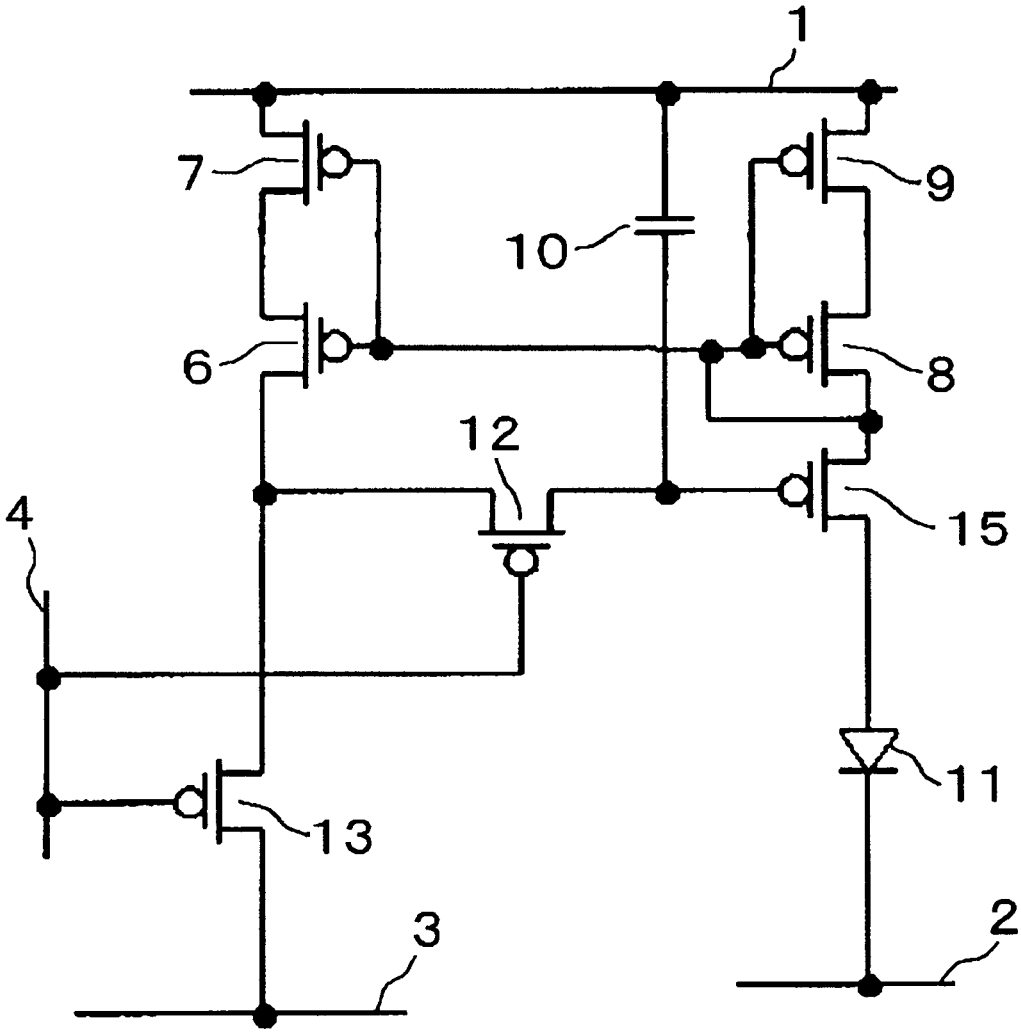
FIG. 15 is a circuit diagram showing the current driver circuit according to a fifth embodiment of the present invention.

Explanation next regards the current driver circuit according to a fifth embodiment of the present invention with reference to FIG. 15. The current driver circuit shown in FIG. 15 is the circuit shown in FIG. 3 with p-channel MOS transistor 15 inserted between the drain of transistor 8 and the anode of organic EL element 11, i.e., a Wilson current mirror circuit. P-channel MOS transistor 15 is typically a TFT. The drain and gate of transistor 6 are not connected together directly, but rather, switch transistor 12 is provided between the drain of transistor 6 and the gate of transistor 15, and the gate of transistor 6 is connected directly to the gate of transistor 8. The gate of transistor 8 is connected not only to the gate of transistor 9 but also to the drain of transistor 8. Holding capacitor 10 is provided between power supply line 1 and the gate of transistor 15.

By adopting the configuration of a Wilson current mirror circuit, this current driver circuit reduces the dependency upon the power supply voltage of the output current that flows to organic EL element 11. The operation of this current driver circuit is similar to the operation of the circuit shown in FIG. 3. In addition, the use of the current driver circuit shown in FIG. 15 allows the constitution of an image display device that is similar to the image display device shown in FIG. 7.

Figure 16:
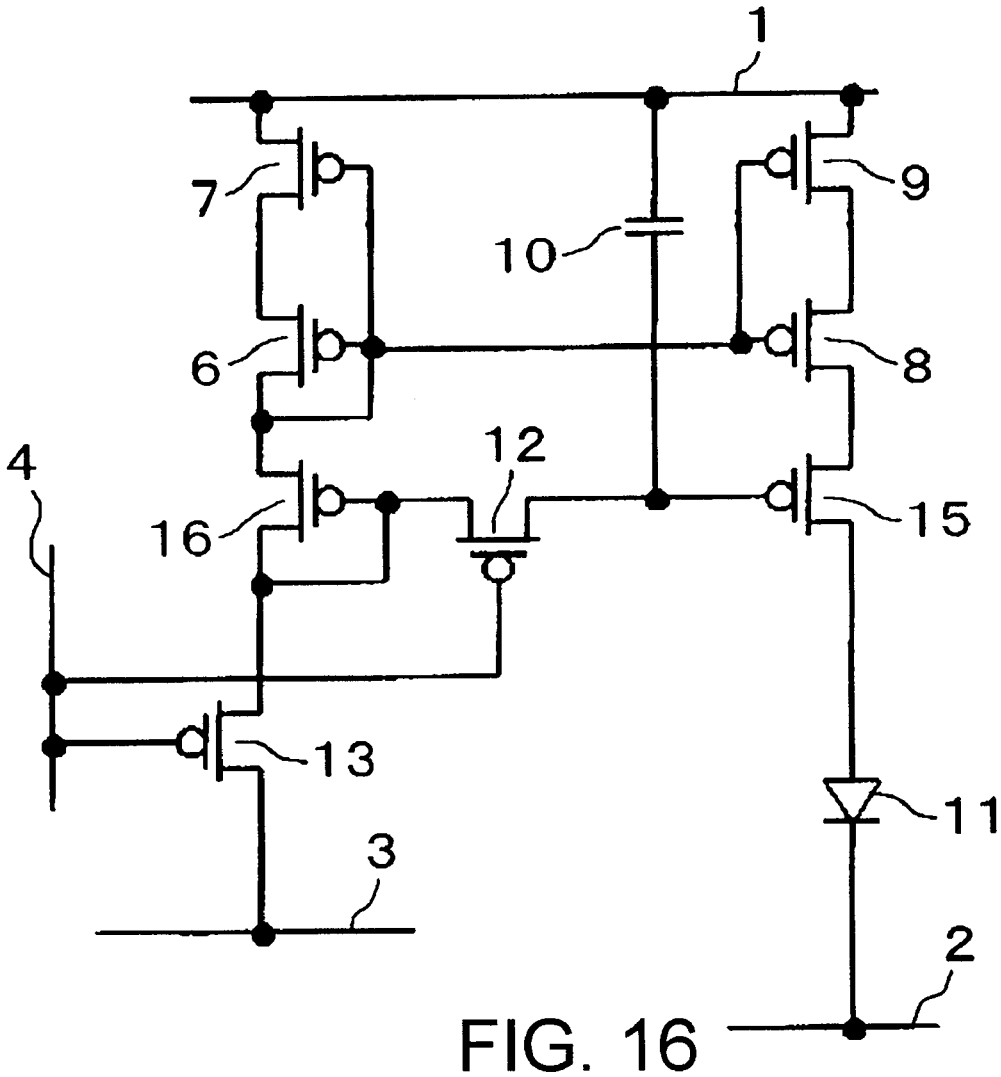
FIG. 16 is a circuit diagram showing the current driver circuit according to a sixth embodiment of the present invention.

The current driver circuit according to a sixth embodiment of the present invention shown in FIG. 16 is a circuit in which p-channel MOS transistors 15 and 16, which are TFTS, have been added to the circuit shown in FIG. 3 to equalize the source-to-drain voltage of transistors 6 and 8 and reduce the change in output current with respect to the power supply voltage. In other words, in the circuit shown in FIG. 3, transistor 16 is added between the drain of transistor 6 and switch transistor 13, the drain and gate of transistor 16 are connected together, and transistor 15 is added between the drain of transistor 8 and the anode of organic EL element 11. Switch transistor 12 is provided between the gate of transistor 15 and the gate of transistor 16, and the gate of transistor 6 and the gate of transistor 8 are connected directly. Holding capacitor 10 is provided between power supply line 1 and the gate of transistor 15.

The circuit shown in FIG. 16 is essentially a two-stage current mirror circuit in cascade connection, the current mirror circuit that is more distant from organic EL element 11, which is the load, being a current mirror circuit of double-gate structure as described in the foregoing explanation. The number of stages of cascade-connected current mirror circuits is not limited to two and may be three or more, but the use of too many stages may result in a drop in the efficiency of voltage use. When a cascade connection is adopted, MOS transistors that operate in the non-saturation region are not added to the current mirror circuit of each stage, but rather, MOS transistors that operate in the non-saturation region are added only to the current mirror circuit of the stage that is most remote from the load, that is, organic EL element 11, and this stage alone is constituted as the above-described current mirror circuit of double-gate structure.

The operation of the current driver circuit shown in FIG. 16 is equivalent to the operation of the circuit shown in FIG. 3. In addition, the use of the current driver circuit shown in FIG. 16 enables an image display device to be constituted that is similar to the image display device shown in FIG. 7.

Figure 17:
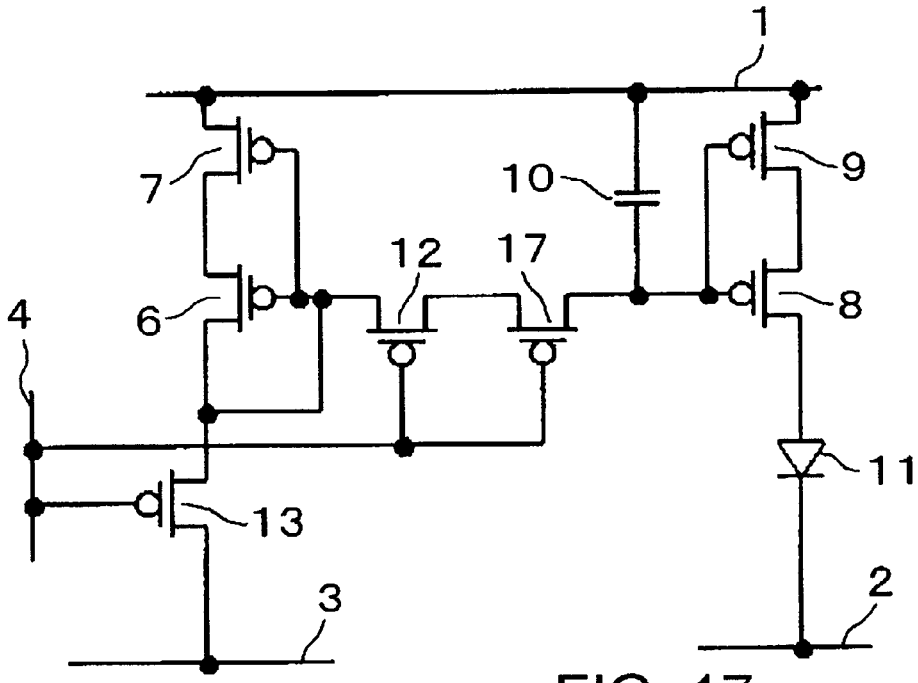
FIG. 17 is a circuit diagram showing the current driver circuit according to a seventh embodiment of the present invention.

The current driver circuit according to a seventh embodiment of the present invention shown in FIG. 17 is a circuit in which switch transistor 17, which is a p-channel MOS transistor, is added to the circuit shown in FIG. 3 in a series to switch transistor 12 to reduce the leak current of switch transistor 12. The gate of switch transistor 17 is connected to the gate of switch transistor 12 and is thereby connected to selection line 4.

When leak current occurs in switch transistor 12, the charge that has accumulated in holding capacitor 10 leaks during the cutoff time of switch transistor 12, the voltage across both ends of holding capacitor 10 changes, and the current that flows to organic EL element 11 diverges from the original current, and this brings about deterioration in the picture quality when used in a display device. In the circuit of this seventh embodiment, the addition of switch transistor 17 in a series to switch transistor 12 reduces the leak current and prevents a deterioration in picture quality when applied to a display device.

Figure 18:
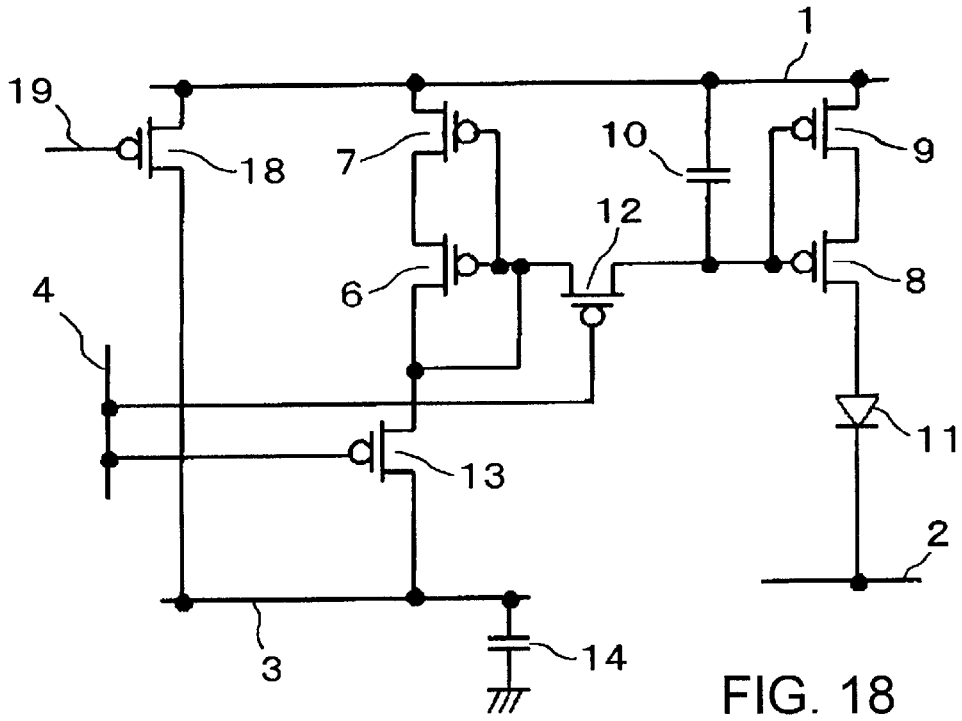
FIG. 18 is a circuit diagram showing the current driver circuit according to an eighth embodiment of the present invention.
Figure 19:
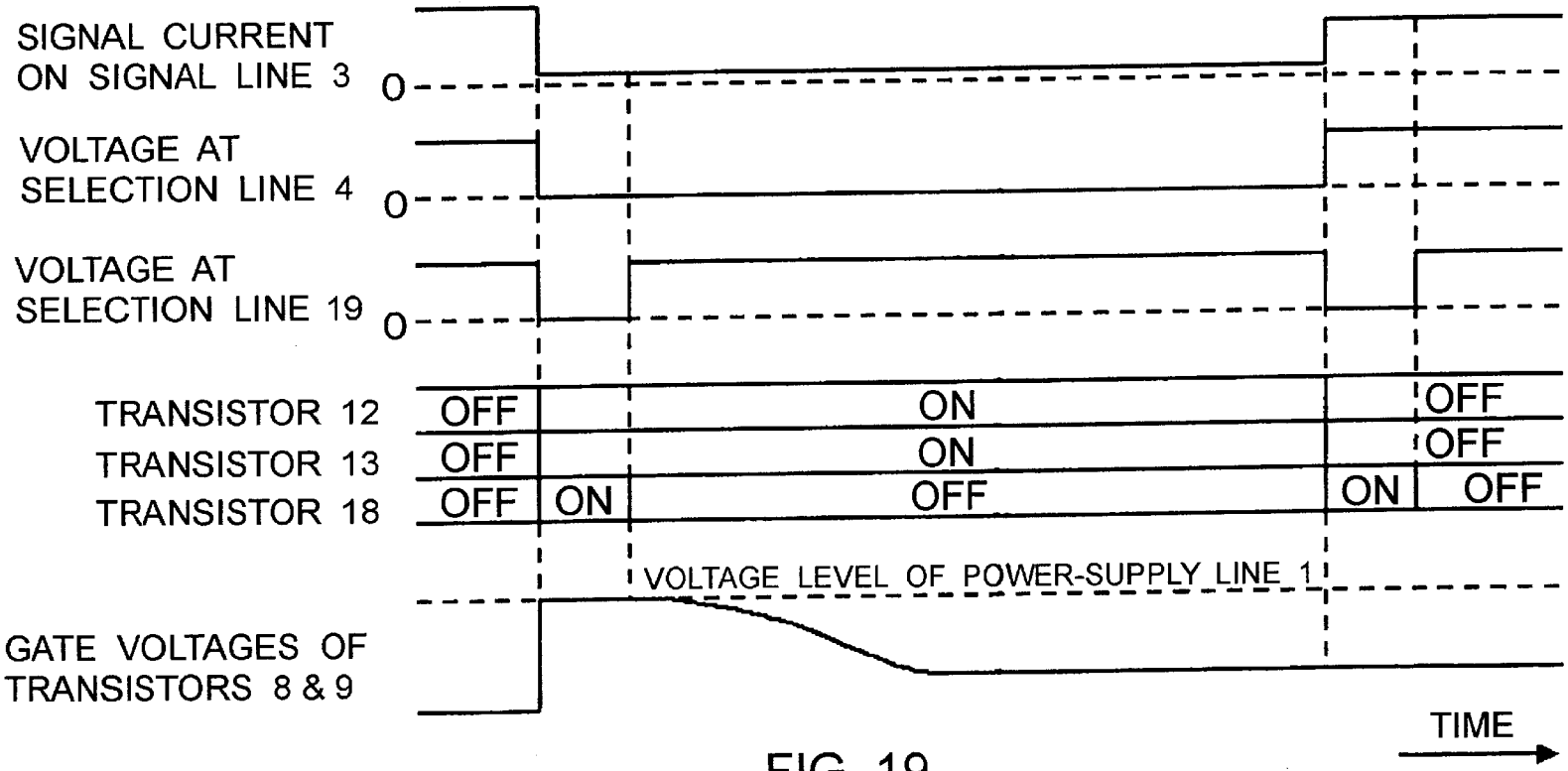
FIG. 19 is a timing chart showing the operation of the circuit shown in FIG. 18.

The current driver circuit according to an eighth embodiment of the present invention is next explained using FIGS. 18 and 19. The current driver circuit of the eighth embodiment shown in FIG. 18 is a configuration in which resetting transistor 18 is provided between power supply line 1 and signal line 3 in the circuit shown in FIG. 14. Resetting transistor 18 is a p-channel MOS transistor having its gate connected to selection line 19. FIG. 19 shows the operation timing of the circuit of FIG. 18.

In the circuit shown in FIG. 14, when the signal current supplied from signal line 3 changes from the maximum current (white level) to the minimum current (black level), holding capacitor 10 must discharge from the maximum voltage level to the minimum voltage level. Since the signal current is the minimum current, however, the discharge time lengthens, and the discharge of holding capacitor 10 may not be completed within the selection interval in which selection line 4 is low level. In the case of a current mirror circuit of double-gate construction, the gate-to-source voltage, i.e., the voltage across both ends of holding capacitor 10, will be greater than the gate-to-source voltage of the current mirror circuit of single-gate structure such as the circuit shown in FIG. 1 as an example of a circuit of the prior art. Accordingly, as described in the foregoing explanation, when the signal current supplied from signal line 3 changes from the maximum current (white level) to the minimum current (black level), the discharge time of the charge that has accumulated in holding capacitor 10 lengthens. When the discharge of holding capacitor 10 does not proceed to completion, potential will remain even though the voltage across both ends of holding capacitor 10 should be at the minimum potential, and when the current driver circuit is used in an image display device, this remaining potential results in "whitening" of the black area and black is not correctly displayed.

To prevent this problem in the circuit according to the eighth embodiment shown in FIG. 18, selection line 19 that is connected to the gate of resetting transistor 18 is set to low level simultaneous with the change of selection line 4 to low level to place resetting transistor 18 in a conductive state. The resetting transistor 18 thus both charges parasitic capacitance 14 that is added to signal line 3 to the voltage level of power supply line 1 and discharges the charge that has accumulated in holding capacitor 10. As shown in FIG. 19, the start of low level of selection line 19 is simultaneous with the start of low level of selection line 4, and the interval of low level of selection line 19 should be a time interval that allows discharge of holding capacitor 10 by way of switch transistors 12, 13, and 18, and thus should be sufficiently shorter than the interval that selection line 4 is low level.

As a minimum, resetting transistors 18 should be provided for each signal line 3 of each column and thus may be provided in circuits outside the active matrix organic EL display panel that drive signal line 3 and selection line 4 (in this case, signals on selection line 19 may be generated from signals on selection lines 4); or may be provided for each picture element within the panel and then constituted by amorphous silicon TFT or polycrystalline silicon TFT as with transistors 6 to 9 and switch transistors 12 and 13.

Figure 20:
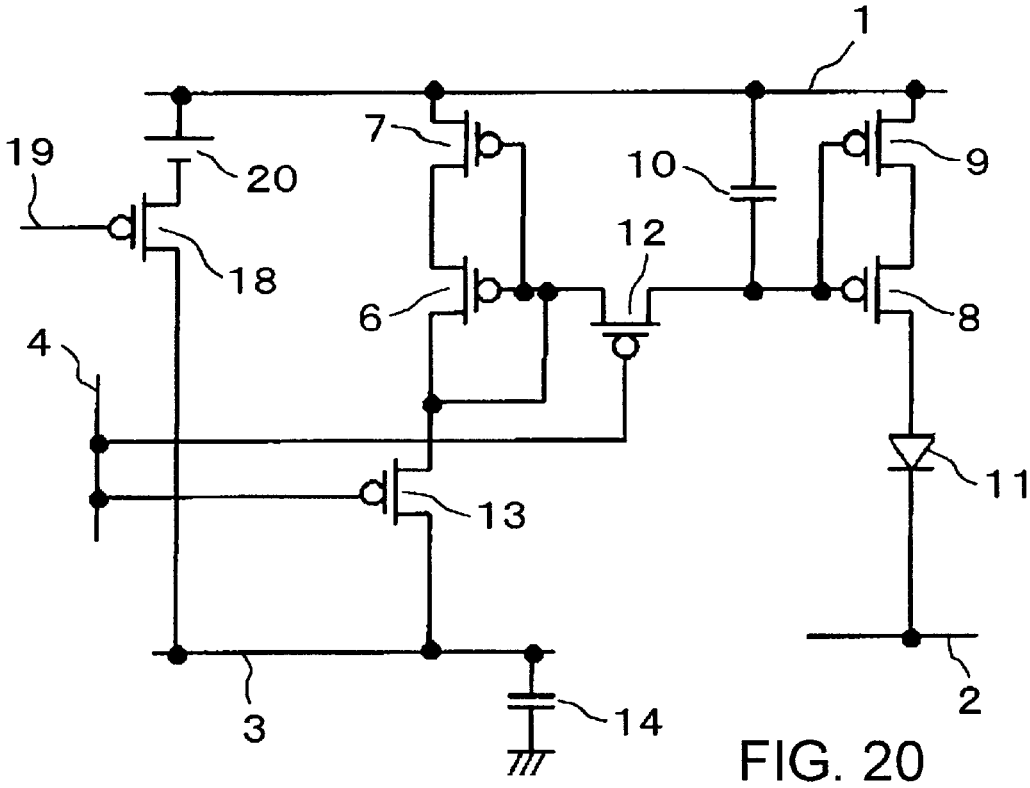
FIG. 20 is a circuit diagram showing the current driver circuit according to a ninth embodiment of the present invention.
Figure 21:
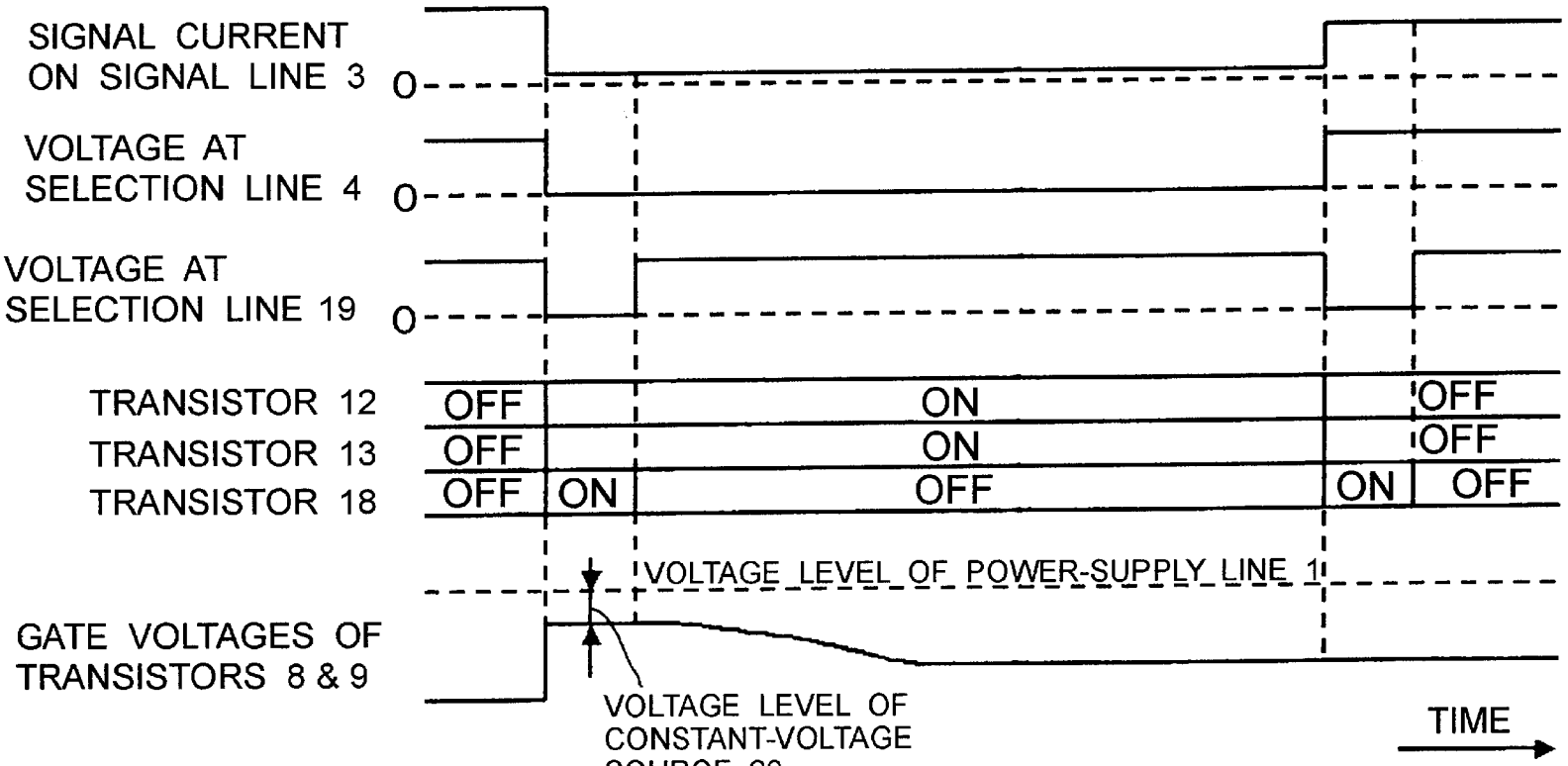
FIG. 21 is a timing chart showing the operation of the circuit shown in FIG. 20.

The current driver circuit according to a ninth embodiment of the present invention is next described using FIGS. 20 and 21.

The circuit shown in FIG. 20 is a circuit in which constant-voltage source 20 is provided between the source of resetting transistor 18 and power supply line 1 in the circuit shown in the above-described FIG. 18. FIG. 21 shows the operation timing of the circuit of FIG. 20.

In the circuit shown in FIG. 18, holding capacitor 10 discharges up to the voltage level of power supply line 1 by means of resetting transistor 18, but when each of the transistors that constitute the current driver circuit are constituted by amorphous silicon TFT or polycrystalline silicon TFT, the threshold values of the transistors are high and the gate-to-source voltage is accordingly also high. The minimum current (black level) of the signal current that is supplied from signal line 3 is typically on the order of several nanoamperes, and at this current level, the above-described gate-to-source voltage of the TFT may reach 2 to 3 V. As a result, holding capacitor 10 need not be completely discharged by resetting transistor 18, and a voltage of 1 to 2 V may remain. Thus, the voltage of constant-voltage source 20 in the circuit of the ninth embodiment shown in FIG. 20 may be set to a voltage level that permits this remnant, and the final voltage value of holding capacitor 10 when resetting transistor 18 has been placed in the conductive state converges on the voltage level of constant-voltage source 20. As shown in FIG. 21, when selection line 4 switches to low level and the signal current is supplied from signal line 3 in the circuit shown in FIG. 20, holding capacitor 10 begins charging from the voltage level of constant voltage source 20, and the time for holding capacitor 10 to attain a prescribed voltage level that accords with the signal current can be made shorter than in the circuit shown in FIG. 18. A constant-voltage diode or any constant-voltage element that uses the forward-direction characteristic of a diode may be used as constant-voltage source 20.

Although preferable embodiments of the present invention have been described for cases in which MOS transistors typically constituted as TFTs were used as transistors 6 to 9, 15 and 16, and switch transistors 12, 13, and 18, the present invention is not limited to this form. Transistors 6 to 9, 15, and 16 are not limited to MOS transistors, and other insulated-gate field-effect transistors may be used. An insulated-gate structure is not absolutely necessary, any other type of transistor being usable as long as it has a gate resistance that is capable of holding the charge that has accumulated in holding capacitor 10 within the interval of one of the periods during which selection line 4 is active. In addition, various types of transistors other than MOS transistors or transfer gates may be used for switch transistors 12, 13, and 18. Finally, although organic EL elements were used as the current-driven elements in the embodiments described hereinabove, the present invention is not limited to this form, and other elements such as laser diodes (LD) or light-emitting diodes (LED) may be used.

While preferred embodiments of the present invention have been described using specific terms, such description is for illustrative purposes only, and it is to be understood that changes and variations may be made without departing from the spirit or scope of the following claims.

What is claimed is:

1. A current driver circuit, comprising:

a current mirror circuit having at least a first transistor and a second transistor, said first transistor generating gate potential that accords with a drain current thereof, and said second transistor having a drain connected to a current-driven element, wherein application of a potential that accords with the gate potential of said first transistor to a gate of said second transistor causes said second transistor to drive said current-driven element at a current that accords with the drain current of said first transistor;

holding capacitor for holding gate potential of said second transistor;

a first switch element for connecting the drain of said first transistor to a signal line that provides a signal current in accordance with a received control signal;

a second switch element that enters either a conductive state or a cutoff state in accordance with a received control signal, and that causes said current mirror circuit to operate when in the conductive state and that both prevents operation of said current mirror circuit and cuts off a charge/discharge path from said holding capacitor when in the cutoff state;

a line for providing a source current of said first transistor and a source current of said second transistor;

a third transistor that is inserted between said line and a source of said first transistor and that operates in a non-saturation region; and a fourth transistor that is inserted between said line and a source of said second transistor and that operates in a non-saturation region.

2. The current driver circuit according to claim 1, wherein one or more additional current mirror circuits are inserted between said third and fourth transistors and said current mirror circuit.

3. The current driver circuit according to claim 1, further comprising a fifth transistor that is inserted between said second transistor and said fourth transistor, wherein said first, second and fifth transistors operate as a Wilson current mirror circuit.

4. The current driver circuit according to claim 1, wherein:

a gate of said third transistor is connected to a gate of a transistor having its source directly connected to a drain of said third transistor; and a gate of said fourth transistor is connected to a gate of a transistor having its source directly connected to a drain of said fourth transistor.

5. The current driver circuit according to claim 1, wherein said first, second, third, and fourth transistors are thin-film transistors of same conductivity having insulated gates, channel widths of said first and third transistors equal are same, channel widths of said second and fourth transistors equal are same, and ratio of the channel width of said first transistor to the channel width of said second transistor is N:1, where $N \geqq 1$.

6. The current driver circuit according to claim 1, further comprising a selection line that supplies said control signal to said first switch element and said second switch element.

7. The current driver circuit according to claim 1, further comprising:

a first selection line for supplying a first control signal to said first switch element, and a second selection line for supplying a second control signal to said second switch element;

wherein said second control signal causes said second switch element to enter the cutoff state, following which said first control signal causes said first switch element to enter the cutoff state.

8. A current driver circuit according to claim 1, wherein said current-driven element is an organic EL element.

9. A current driver circuit, comprising:

a first transistor;

a second transistor that works together with said first transistor to operate as a current mirror circuit and that drives a current-driven element that is connected to its drain;

holding capacitor that holds a gate potential that is provided to said second transistor during operation as said current mirror circuit;

a first switch element that, according to a control signal, connects a drain of said first transistor to a signal line that provides a signal current;

a second switch element that, according to a control signal, causes said first transistor and said second transistor to work together to operate as said current mirror circuit, and that cuts off a charge/discharge path from said holding capacitor when said current mirror circuit is not caused to operate;

a third transistor that has its gate connected to a gate of said first transistor, that is connected in a series to a source of said first transistor, and that operates in a non-saturation region; and a fourth transistor that has its gate connected to a gate of said second transistor, that is connected in a series to a source of said second transistor, and that operates in a non-saturation region.

10. The current driver circuit according to claim 9, wherein the gate and drain of said second transistor are directly connected, and said second switch element is inserted between the gate of said first transistor and the gate of said second transistor.

11. The current driver circuit according to claim 9, wherein said second switch element is inserted between the gate and drain of said second transistor, and the gate of said first transistor and the gate of said second transistor are directly connected.

12. The current driver circuit according to claim 9, further comprising means for precharging said signal line.

13. The current driver circuit according to claim 12, wherein said means for precharging comprises:

a power supply that generates a prescribed voltage; and a third switch element for connecting said power supply to said signal line.

14. The current driver circuit according to claim 9, wherein said first, second, third, and fourth transistors are thin-film transistors of same conductivity having insulated gates, channel lengths of said first and second transistor are same, channel lengths of said third and fourth transistors are same, and the channel length of said third transistor is a minimum of one time and a maximum of four times the channel length of said first transistor.

15. An image display device in which a plurality of luminous elements that emit light by driving currents are arranged in matrix form;

wherein:

a said luminous element is provided for each picture element;

selection lines that provide selection signals to each picture element and signal lines that provide a signal current, which corresponds to the driving current of the luminous element of each picture element, to each picture element are arranged in matrix form; and each of said picture elements comprises:

a current mirror circuit having at least a first transistor and a second transistor, said first transistor generating a gate potential that accords with a drain current thereof, and a second transistor having a drain connected to said luminous element, wherein application of a potential that accords with the gate potential of said first transistor to a gate of said second transistor causes said second transistor to drive said luminous element at a current that accords with the drain current of said first transistor;

a holding capacitor for holding gate potential of said second transistor;

a first switch element for connecting the drain of said first transistor to said signal line in accordance with said control signal;

a second switch element that enters either a conductive state or a cutoff state in accordance with said control signal, that causes said current mirror circuit to operate when in the conductive state, and that both prevents operation of said current mirror circuit and cuts off a charge/discharge path from said holding capacitor when in the cutoff state;

a third transistor that is inserted between a line that provides a source current of said first transistor and a source current of said second transistor and the source of said first transistor and that operates in a non-saturation region; and a fourth transistor that is inserted between said line and the source of said second transistor and that operates in a non-saturation region.

16. The image display device according to claim 15, wherein said luminous elements are organic EL elements.

17. An image display device in which a plurality of luminous elements that emit light by driving currents are arranged in matrix form;

wherein:

a said luminous element is provided for each picture element;

selection lines that provide selection signals to each picture element and signal lines that provide a signal current, which corresponds to the driving current of the luminous element of each picture element, to each picture element are arranged in matrix form; and each of said picture elements comprises:

a first transistor;

a second transistor that has its drain connected to said luminous element and that works together with said first transistor to operate as a current mirror circuit;

holding capacitor that holds a gate potential that is provided to said second transistor during operation as said current mirror circuit;

a first switch element that, according to said control signal, connects a drain of said first transistor to said signal line;

a second switch element that, according to said control signal, causes said first transistor and said second transistor to work together to operate as said current mirror circuit, and that cuts off a charge/discharge path from said holding capacitor when said current mirror circuit is not caused to operate;

a third transistor that has its gate connected to a gate of said first transistor, that is connected in a series to a source of said first transistor, and that operates in a non-saturation region; and a fourth transistor that has its gate connected to a gate of said second transistor, that is connected in a series to a source of said second transistor, and that operates in a non-saturation region.

18. The image display device according to claim 17, wherein said luminous elements are organic EL elements.

* * * * *